US011687039B2

(12) United States Patent
Netuschill

(10) Patent No.: US 11,687,039 B2
(45) Date of Patent: Jun. 27, 2023

(54) METHOD FOR ASSEMBLING AT LEAST TWO ELEMENTS

(71) Applicant: Comadur SA, Le Locle (CH)

(72) Inventor: Alexandre Netuschill, Le Cerneux-Pequignot (CH)

(73) Assignee: Comadur SA, Le Locle (CH)

( * ) Notice: Subject to any disclaimer, the term of this patent is extended or adjusted under 35 U.S.C. 154(b) by 941 days.

(21) Appl. No.: 16/545,715

(22) Filed: Aug. 20, 2019

(65) Prior Publication Data

US 2020/0089166 A1 Mar. 19, 2020

(30) Foreign Application Priority Data

Sep. 14, 2018 (EP) ..... 18194458

(51) Int. Cl.

| | |
|---|---|
| ***G04B 45/00*** | (2006.01) |
| ***A44C 5/12*** | (2006.01) |
| ***C25D 1/02*** | (2006.01) |
| ***G04B 19/12*** | (2006.01) |
| ***G04B 19/28*** | (2006.01) |
| ***G04B 37/22*** | (2006.01) |

(52) U.S. Cl.

CPC ..... *G04B 45/0076* (2013.01); *A44C 5/12* (2013.01); *C25D 1/02* (2013.01); *G04B 19/12* (2013.01); *G04B 19/283* (2013.01); *G04B 37/22* (2013.01)

(58) Field of Classification Search

CPC ..... G04B 45/0076; G04B 19/12; G04B 37/22

See application file for complete search history.

(56) References Cited

U.S. PATENT DOCUMENTS

| | | | | |
|---|---|---|---|---|
| 2007/0190285 | A1 | 8/2007 | Jou | |
| 2009/0038339 | A1 | 2/2009 | Chen | |
| 2011/0119891 | A1 | 5/2011 | Bianco et al. | |
| 2014/0112112 | A1* | 4/2014 | Plankert | G04B 37/226 264/603 |
| 2014/0178625 | A1 | 6/2014 | Lauper et al. | |
| 2015/0092524 | A1 | 4/2015 | Verdon | |

(Continued)

FOREIGN PATENT DOCUMENTS

| | | | |
|---|---|---|---|
| CN | 102566395 | A | 7/2012 |
| CN | 103362232 | A | 10/2013 |

(Continued)

OTHER PUBLICATIONS

Office Action dated Feb. 9, 2021 in corresponding Indian Patent Application No. 201944035919 (with English Translation), 6 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A method for assembling at least a first element and a second element to form, once assembled, an external component for a portable device, including the steps of: a) making the first element; b) making the second element; c) arranging at least a first groove in the first element and at least a second groove in the second element; d) placing and holding the first and second element end-to-end with at least a third connecting element which is inserted and locked in the first and second grooves.

30 Claims, 2 Drawing Sheets

(56) References Cited

U.S. PATENT DOCUMENTS

| | | | |
|---|---|---|---|
| 2015/0289612 | A1 | 10/2015 | Lauper et al. |
| 2015/0289613 | A1 | 10/2015 | Lauper et al. |
| 2015/0327635 | A1 | 11/2015 | Lauper et al. |

FOREIGN PATENT DOCUMENTS

| | | | |
|---|---|---|---|
| CN | 104161356 | A | 11/2014 |
| CN | 104936478 | A | 9/2015 |
| CN | 105531163 | A | 4/2016 |
| CN | 107850868 | A | 3/2018 |
| DE | 196 23 806 | A1 | 12/1996 |
| EP | 2 138 323 | A1 | 12/2009 |
| EP | 2 796 297 | A1 | 10/2014 |
| EP | 2 813 900 | A2 | 12/2014 |
| JP | 55-116284 | U | 2/1979 |
| JP | 9-276964 | A | 10/1997 |
| JP | 2015-72270 | A | 4/2015 |
| KR | 10-2014-0081730 | A | 7/2014 |
| WO | WO 2014/096260 | A1 | 6/2014 |
| WO | WO 2017/097613 | A1 | 6/2017 |

OTHER PUBLICATIONS

Korean Office Action dated Oct. 29, 2020 in Korean Patent Application No. 10-2019-0109981 (with English translation), 14 pages.
Japanese Office Action dated Oct. 6, 2020 in Japanese Patent Application No. 2019-164184 (with English translation), 12 pages.
European Search Report dated Mar. 20, 2019 in European Application 18194458.8, filed on Sep. 14, 2018 (with English Translation of Categories of Cited Documents & Written Opinion).
Office Action dated Jun. 9, 2020 in corresponding Japanese Patent Application No. 2019-164184 (with English Translation), 10 pages.
Chinese Office Action dated Mar. 11, 2023 in Chinese Patent Application No. 201910862150.6, 24 pages (with English Translation).

* cited by examiner

METHOD FOR ASSEMBLING AT LEAST TWO ELEMENTS

CROSS-REFERENCE TO RELATED APPLICATION

This application claims priority to European Patent Application No. 18194458.8 filed on Sep. 14, 2018, the entire disclosure of which is hereby incorporated herein by reference.

The present invention concerns a method for assembling at least two elements to form an external component, particularly made of ceramic, for a portable device, together with an external component obtained by this method. Each element is formed from a material with distinct physical and/or aesthetic characteristics.

FIELD OF THE INVENTION

The invention will find application in the assembly manufacturing of an external component intended, preferably but not exclusively, for the field of horology. Preferably, such a component may be, for example, a watch bezel intended to be placed on a watch case, a bracelet link, a dial, a watch case, or a clasp element.

The invention will also find application in the manufacturing of external components used in the fields, non-exhaustively, of mobile and cellular telephones, portable computer terminals, for example to form mobile phone or tablet cases, or in the field of jewelry or tableware.

The invention is particularly intended for the assembly of elements made of hard materials, i.e. shock and scratch resistant materials. These hard materials may, in particular, be technical ceramics. Further, each element can be made of zirconium dioxide or 'zirconia', aluminium dioxide or 'alumina', or of another composite material integrating a ceramic support and a metal matrix or 'cermet'. Each element of the external component according to the invention can also be made of synthetic sapphire or ruby.

BACKGROUND OF THE INVENTION

For aesthetic reasons, it is sometimes desirable to make external components, especially external timepiece components, which have a different appearance depending on the area of the component. By way of example, it is well known to make watch bezels in two-colour ceramic, having two different coloured areas.

A known technique consists in subjecting the component made of a first material to successive surface treatments, for example by applying paint or metal layers of different appearance using chemical or physical vapour deposition (CVD or PVD) technologies, by partially masking the area or areas of the component whose appearance is not desired to be changed. The main drawback of these treatments lies in the fact that, when a treated surface of the component comes into contact with a foreign body higher in hardness than the deposited layer, it is likely to be scratched and expose the first material, which is unacceptable for products whose aesthetic appearance is vital to the consumer.

When the external component is made of a technical ceramic, it is known to make two-colour components directly by injection moulding, particularly by bi-injection moulding two different coloured ceramic materials, and sintering. However, this manufacturing technique is complex to implement with a view to obtaining a clear demarcation between the two materials which is difficult to obtain.

Indeed, it is difficult to adapt the sintering parameters so that, on the one hand, the colours are in their optimum configuration, and on the other hand, to avoid the phenomena of diffusion of one colour into the other which is detrimental to the obtention of a clear demarcation between the different coloured parts of the component.

Purely aesthetically, it is possible to colour a component formed of a single element by impregnation, making it possible to obtain different colours in different areas of said component. However, the colours are limited by the colouring of the material forming the component and by impregnation techniques. Moreover, once again, the sintering step involves adaptation of parameters and does not produce an optimal result.

Another known approach for making two-colour components consists in assembling elements of different colours to each other by gluing abutting portions of the elements. However, the components obtained by this technique are inevitably more fragile than one-piece components. Further, depending on the dimensions of the elements to be assembled, the gluing operations can be complex and tedious.

SUMMARY OF THE INVENTION

It is an object of the invention to overcome the drawbacks of the aforementioned prior art by providing an external component, particularly an external timepiece component, having a different appearance depending on the area of the component, which is simple and economical to make.

It is also an object of the invention to provide an external component, particularly a two-colour component, wherein the demarcation between the different coloured parts of the component is clear.

To this end, the invention concerns a method for assembling at least a first element and a second element to form, once assembled, an external component for a portable device, including the steps of:

a) making the first element;

b) making the second element;

c) arranging at least a first groove in the first element and at least a second groove in the second element;

d) placing and holding the first and second element end-to-end by means of at least a third connecting element which is inserted and locked in the first and second grooves.

The invention thus proceeds from the general inventive idea which consists in assembling at least two, previously individually manufactured elements, of different natures and/or colours, in order to obtain an optimal configuration for each element in both mechanical and aesthetic terms.

According to an advantageous embodiment, the step of inserting and locking the third element in the first and second grooves consists in filling the first and second grooves by inlaying an at least partially amorphous metallic material.

Indeed, the viscosity of amorphous materials drops sharply at low temperatures, which means they can be shaped at low-stress levels. More particularly an amorphous metal is shaped between its glass transition temperature and its crystallization temperature. For example, for a platinum-based amorphous metal, the inlaying process is performed at around 300° C. (degrees Celsius) for a viscosity of up to 103 Pa·s (pascal-seconds) and at a stress of 1 MPa (Megapascal), instead of a viscosity of 1012 Pa·s−1 at the glass transition temperature. This viscosity makes it possible to obtain improved adhesion characteristics. The low viscosity of amorphous metals at this temperature range firstly allows them to perfectly fill the space in which they are constrained and at low pressure levels. Thus, in the case of filling a groove, this ability to perfectly match the contours makes it possible to exactly fill the recesses.

Low-temperature shaping henceforth allows the use of materials that have not previously been used due to their poor thermal resistance (such as a fall in mechanical properties, oxidation or a low melting point) or their poor thermal shock resistance.

The use of an inlay made of at least partially amorphous metallic material allows for low-stress and low-temperature shaping, for example using a hot press.

The metal inlay can be made on a visible or non-visible face of the external component, on junction portions extending at least on either side of the contact surfaces of said elements placed end-to-end. Such a metal inlay is made inside at least one groove, particularly in the form of at least one recess made along each portion joining the elements to each other.

According to an alternative embodiment, the first and second elements are made of an electrically conductive material or the walls of the grooves are coated with an electrically conductive layer, characterized in that the step of inserting and locking the third element in the first and second grooves consists in filling the first and second grooves with a metal by an electroforming process.

According to other advantageous variants of the invention:

- the material of the first element is different from the material of the second element.
- the first element has a first appearance and the second element has a second appearance different from that of the first element.
- the first groove is in communication with the second groove when the two elements are placed end-to-end.
- after step d) there is a step consisting in trimming said third element until the surfaces of the first, second and third elements are seamlessly connected to one another.
- said first material and said second material are polycrystalline or single crystal ceramic materials, made from aluminium oxide, zirconium oxide, tungsten carbide, silicon nitride, silicon carbide, tungsten carbide or cermets.
- the material forming the third element is chosen from the following group: precious or semi-precious metals.
- the material forming the third element is chosen from the group including alloys of gold, platinum or palladium.
- each groove has a trapezoidal cross section, the side walls of each groove being inclined and converging in the direction of the exterior from the inside.
- each groove is machined either on the upper side, or the lower side of said first element and second element.
- each groove extends over the entire length of the first element and second element.
- each groove has a depth comprised between 0.05 mm and 4 mm.
- said external component is on a portable timepiece device, such as a watch.

The invention also concerns an external component obtained by implementing such an assembly method.

The invention also concerns an external component, including at least:

- a first element and a second element assembled in at least one junction area;
- a first groove arranged in said first element and a second groove arranged in said second element, said first groove and second groove extending at least into each junction area;
- a third element, at least partially filling the first groove and second groove in each junction area of the first element and second element.

According to an advantageous first embodiment of the external component of the invention, said third element is an at least partially amorphous metallic material inlaid in said first and second grooves.

According to a second embodiment of the external component of the invention, said third element is a metallic material electroformed in said first and second grooves.

Advantageously, the external component forms a watch bezel, a bracelet link, a dial, a watch case or clasp element. This component may thus have an annular shape in which each element consists of an annular arc portion, particularly to form a watch bezel.

BRIEF DESCRIPTION OF THE DRAWINGS

The invention will be described in more detail hereinafter with reference to the annexed drawings, given by way of non-limiting examples, representing different steps for assembling several elements in order to obtain an external component, in which.

Figure 1:
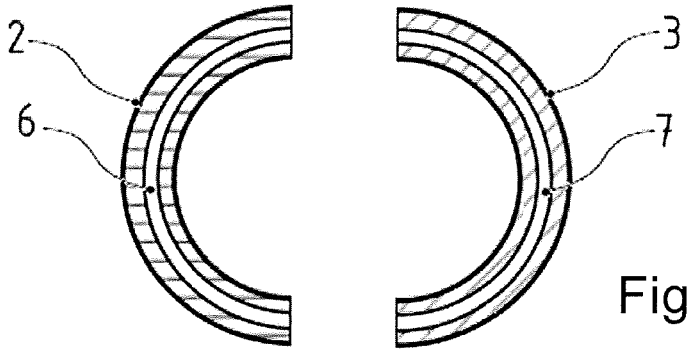
FIG. 1 schematically represents an elevation view of two separate elements, of semi-annular shape, highlighting the different materials.
Figure 2:
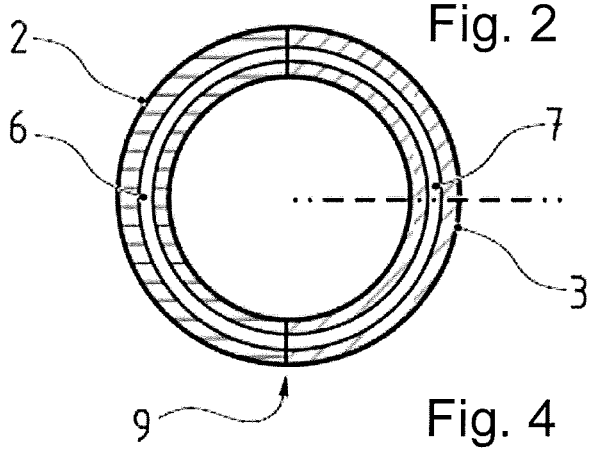
FIG. 2 schematically represents an elevation view of the two abutting elements before they are secured to each other.
Figure 3:
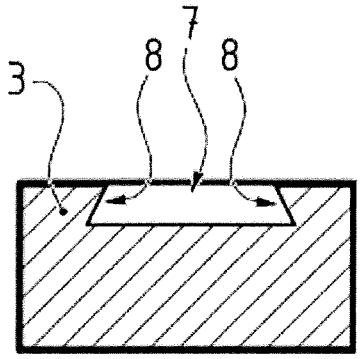
FIG. 3 schematically represents a vertical cross-section view of one of the elements of FIG. 2, showing a groove arranged in one of the elements.
Figure 4:
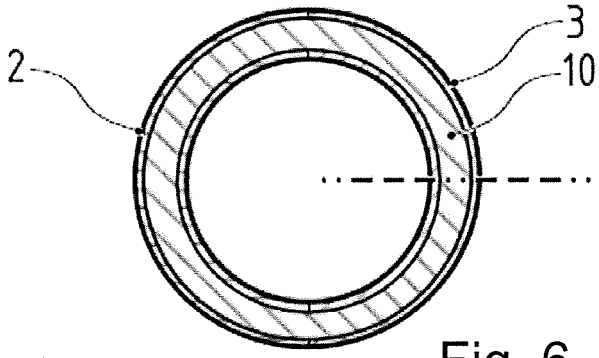
FIG. 4 schematically represents an elevation view of the two elements, after the metal inlaying process.
Figure 5:
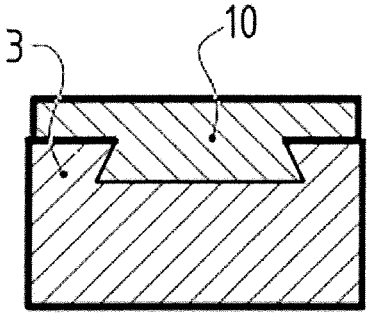
FIG. 5 schematically represents a vertical cross-section view of one of the elements of FIG. 4, showing the excess thickness of the metal inlay.
Figure 6:
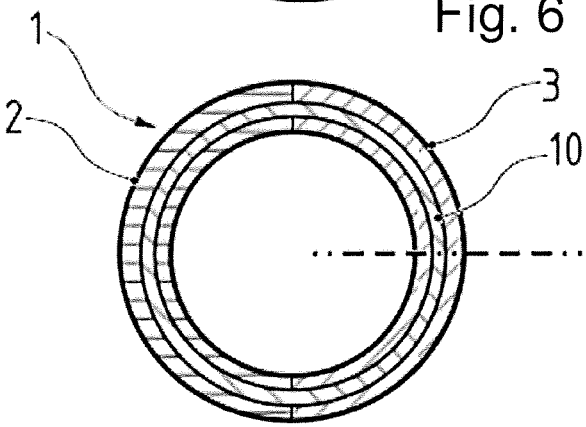
FIG. 6 schematically represents an elevation view of an annular external component obtained after removal of the excess thickness of the metal inlay.
Figure 7:
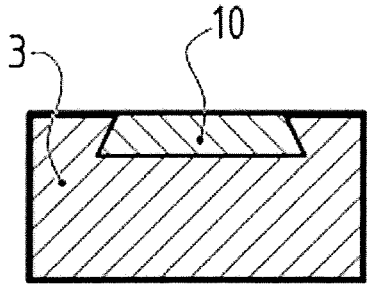
FIG. 7 schematically represents a vertical cross-section view of the component of FIG. 6.

Said Figures show an example of certain implementation steps of the assembly method of the invention for obtaining an external component, on the one hand, of flattened annular shape, from two semi-annular elements capable of forming a ring intended to be placed on a portable timepiece device. On the other hand, the Figures show an example of a mobile telephone case, made from three elements.

More broadly, the invention makes it possible to obtain an external component from more elements, assembled to each other by a metal inlay. The component obtained can have any shape—circular, annular, oval or polygonal—and the assembled elements have complementary shapes, the arrangement of which provides said overall shape of the external component. Such a component can have a polygonal, parallelepiped, tapered or more complex shape, or have convex or concave side edges.

DETAILED DESCRIPTION OF THE INVENTION

The present invention concerns a method for making an external component 1 by assembling several elements, at least a first element 2 and a second element 3. Such an assembly to obtain such a component 1 can be achieved with more elements, such as a third element 4, as seen in the example represented in FIGS. 8, 9 and 10.

As mentioned above, the invention proposes to obtain an assembly from elements 2, 3, 4 while maintaining the optimal aesthetic and/or physical properties of each element. To achieve this, in a first phase, first element 2 is made. Second element 3 is also made. Another element 4 could also be made, as well as any other additional elements.

Advantageously, if first element 2 and second element 3 have an identical shape, they can be made successively in the same mould, with different materials and/or treatments.

According to another embodiment, several elements 2, 3, 4 can be made at the same time in a single piece inside the same mould, with different materials and/or treatments. The part created is then separated, particularly via a cutting operation, into as many elements 2, 3, 4, shaped and subsequently assembled to form said component 1.

The first and second elements 2, 3 can be made from similar or identical materials, but preferably the material of first element 2 is different from the material of second element 3. As regards other elements 4, the material can be different from the other two elements 2, 3, or only different from the material of the element 2, 3 intended to be assembled thereto (i.e. the other element 4 can be made of identical material to an element 2, 3 which is not adjoined thereto).

The difference in material includes both structure and aesthetics. Indeed, the same base material can have a different appearance, while maintaining virtually identical characteristics. Hence, the appearance of the material of first element 2 can be different from that of the material of second element 3, or from the other elements 4.

Preferably, said first material and said second material are polycrystalline or single crystal ceramic materials, made from aluminium oxide, zirconium oxide, tungsten carbide, silicon nitride, silicon carbide, tungsten carbide or cermets.

The shape of elements 2, 3, 4 corresponds to one part of the overall shape of the component 1 to be made. In the example embodiment seen in FIGS. 1 to 7, the first and second elements 2, 3 have a semi-circular shape, particularly an annular arc, such that, once assembled, component 1 has a circular or annular shape.

Figure 8:
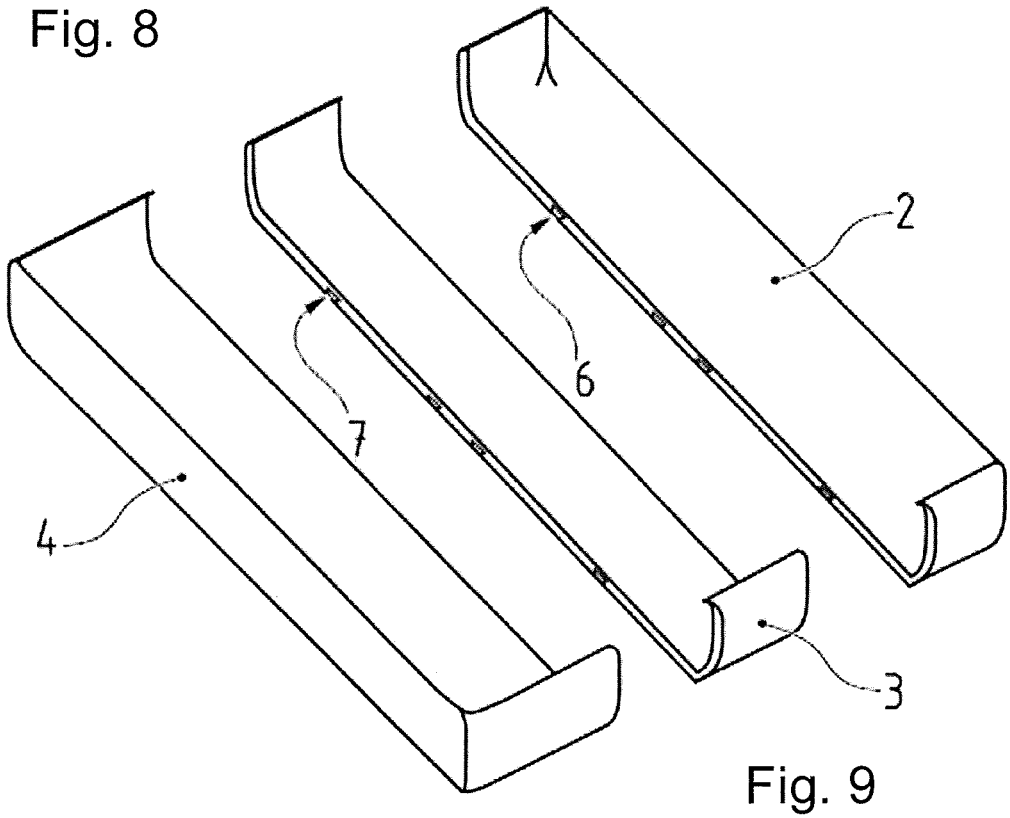
FIG. 8 schematically represents a perspective view of an external component, of the mobile telephone protective case type, formed of three separate elements.
Figure 9:
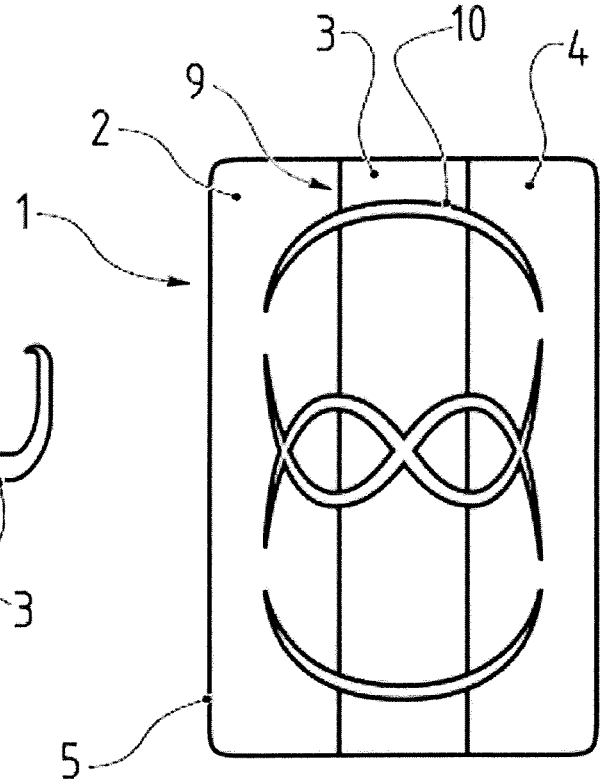
FIG. 9 schematically represents a cross-section view of one of the three elements, showing grooves arranged in the lower face.
Figure 10:
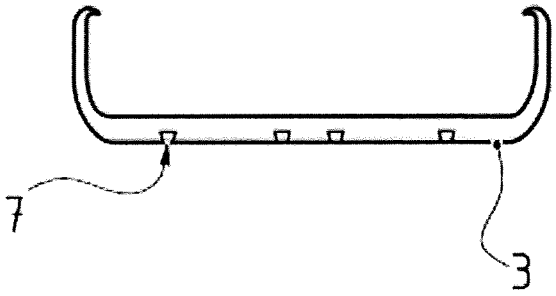
FIG. 10 schematically represents a bottom view of the external component, once the three elements are assembled, showing an example of the shapes and lengths of the various grooves, giving this metal inlay an aesthetic appearance.

According to another embodiment, represented in FIGS. 8 to 10, component 1 is a case 5 for a portable device of the mobile phone type, of generally rectangular parallelepiped shape, in particular with rounded edges. This component 1 of case 5 is formed of three elements 2, 3, 4, in the form of rectangular strips surmounted at the longitudinal ends thereof with edges, the assembly of which provides the overall shape of said component 1.

Other shapes can be envisaged, such as a polygonal component 1, wherein each of elements 2, 3, 4 then represents one or more of its sides. In short, the shapes of elements 2, 3, 4 are complementary to obtain the shape of external component 1 assembled as one piece.

To achieve this, the invention proposes to arrange at least a first groove 6 in first element 2 and at least a second groove 7 in second element 3. There are at least as many grooves 6, 7 made as there are elements 2, 3, 4. The same element 2, 3, 4 can include several grooves 6, 7, as in the example of FIGS. 9 and 10, wherein the same element 2, 3, 4 has four grooves 6, 7. Further, grooves 6, 7 of the same element 2, 3, 4 can coincide, intersect or share a portion of their length, as seen in the example of FIG. 10.

Grooves 6, 7 can be machined mechanically, using a tool provided for this purpose, by abrasion or laser cutting, or any other suitable technique.

Preferably, each groove 6, 7 is machined so that it has a trapezoidal cross section, the side walls of each groove being inclined and converging outwards from the inside, i.e. from the bottom of the groove. Advantageously, the width of each groove 6, 7 is larger than its depth.

Further, each groove 6, 7 can have a depth comprised between 0.05 mm and 4 mm. Further, to avoid weakening component 1, the depth of each groove 6, 7 cannot exceed 90% of the thickness of each element 2, 3, 4.

It will be noted that, depending on the machining operation performed, the depth and width of groove 6, 7 may vary over its length. In particular, as seen in the example of FIG. 10, the ends of grooves 6, 7 may be of smaller width than in junction areas 9 between elements 2, 3, 4, where grooves 6, 7 are wider.

Each groove 6, 7 can have inclined flanks or walls 8 converging from the inside in the direction of the exterior of the groove. In other words, side walls 8 have a negative angle, which will make it possible to retain the assembly material. In short, each groove 6, 7 has a tapered shape, open on one of the sides of elements 2, 3, 4.

To this end, grooves 6, 7 can be machined either on the upper face or on the lower face of said first element 2 and second element 3, and on any other element 4. In short, they can be made from above or below, so that they are or are not visible depending on how component 1 is used as an external part. The filler material can thus be used as a decorative element in the case where the grooves are made on a visible face of the component once it is mounted, for example, on a watch case. In the case of a bezel, it is, for example, possible to envisage the grooves having edges which delimit figurative and/or decorative elements, such as a numeral, a letter or any other motif.

Further, each groove 6, 7 can extend over the entire length of first element 2 and second element 3, and any other element 4. This is the case of the example embodiment of FIGS. 1 to 7, wherein grooves 6, 7 are arranged at the centre and along the length of each first element 2 and second element 3, in order to improve the continuity of the assembly material which will be inserted therein.

In the example embodiment seen in FIGS. 8 to 10, grooves 6, 7 extend over one portion of the surface of elements 2, 3, 4.

In any event, a first groove 6 of a first element 2 is in communication with second groove 7 of a second element 3 when the two elements 2, 3 are placed end-to-end. In short, grooves 6, 7 are made so that at least one of their respective ends coincides with an edge joining their elements 2, 3, 4 to provide continuity of grooves 6, 7 between elements 2, 3, 4.

During the assembly of the invention, first element 2 and second element 3 are placed end-to-end. They are thus positioned opposite each other, in a certain alignment, in order to obtain the desired shape configuration of component 1.

Elements 2, 3, 4 are placed end-to-end in this manner at one of their respective joining edges. Their respective edges are then joined together, placed in tight contact. Consequently, when elements 2, 3, 4 are made, there may be an adjustment step of machining the joining edges of said elements 2, 3, 4, to obtain perfect lines of contact between them, at least in junction areas 9.

Further, elements 2, 3, 4 may be temporarily locked or joined to each other in said configuration, particularly on a support provided for this purpose, by any appropriate means, especially mechanical means, by temporary bonding, etc.

Advantageously, the assembly according to the invention entails maintaining by means of at least a third connecting element 10, which is inserted and locked in first and second grooves 6 and 7. In short, grooves 6, 7 are filled with a third element 10, which ensures the seamless assembly between elements 2, 3, 4, forming a continuous mechanical connection at least in junction areas 9.

As mentioned above, with grooves having a section with inclined side walls converging towards the opening of each groove 6, 7, inserting third element 10 thus forms a dovetail type mechanical connection which retains the third element in the groove.

Third element 10 has a material that is different from the other materials of elements 2, 3, 4, in both composition and appearance. In particular, in a first embodiment, third element 10 comprises an at least partially amorphous metallic material, namely an amorphous or partially amorphous metallic material having properties of malleability, which can be hot pressed to change shape without cracking or breaking and which can be inlaid inside grooves 6, 7. Such an inlay completely fills the internal volume of each groove 6, 7 particularly through deformation of third material 10 which is partially amorphous.

Typically, but non-exhaustively, such amorphous metal alloys which can be implemented in the method of the invention may be zirconium alloys, for example with chemical compositions in the following atomic percentages: Zr67.5Ti8.65Ni9.65Cu10.44Be3.76. Advantageously, said material forming third element 10 is chosen from the following group: precious or semi-precious metals. More precisely, said material forming third element 10 can be chosen from the group including alloys of gold, platinum or palladium. For example, non-exhaustively, the chemical compositions of such amorphous precious metal alloys that can be implemented may have the following atomic percentages: for 'Pt852' platinum Pt57.5Cu14.7Ni5.3P22.5, 'Au18K' gold, 'Pd600' palladium Pd43Cu27Ni10P20 or 'Pd900' palladium Pd77.5Cu6Si16.5.

Advantageously, said material forming third element 10 is of the crystalline type. Such a material may be metallic, such as, for example, aluminium or an alloy containing aluminium. Third element 10 made of aluminium can easily be inlaid using a hot process.

According to a second embodiment of the assembly method of the invention, the first and second elements 2, 3 are made of an electrically conductive material or the walls of grooves 6, 7 are coated with an electrically conductive material. Thus, the step of inserting and locking third element 10 in first and second grooves 6 and 7 can consist in metal filling by an electroforming (or electroplating) process.

It will be noted that a sufficient amount of third element 10 is provided during the inlaying phase to completely fill each groove 6, 7 in junction areas 9 and preferably over all the remaining length of grooves 6, 7. However, recesses in the filling by third element 10 on portions outside junction areas 9 may be envisaged, to provide a distinctive look.

During the inlaying or electroforming filling process, a surplus of third element 10 is formed outside the opening of grooves 6, 7. Consequently, once third element 10 is inserted, the method of the invention provides a subsequent step consisting in trimming said third element 10 until the surfaces of the first 2, second 3 and third 10 elements are seamlessly connected to each other. Preferably, trimming is achieved by milling or turning. This step removes the excess material of third element 10 until it is flush with the surfaces of elements 2, 3, 4. Third element 10 is thus perfectly incorporated in the other elements 2, 3, 4.

An optional additional step of polishing elements 2, 3, 4, 10 to smooth the surfaces and, in the case of a partly visible assembly, to give a smooth and flawless aesthetic appearance.

The assembly method according to the invention thus makes it possible to obtain an external component 1 including at least a first element 2 and second element 3 assembled by means of the assembly method described above.

In every method, the invention also concerns an external component 1 including at least a first element 2 and a second element 3 assembled in at least one junction area 9. A first groove 6 is arranged in said first element 2 and a second groove 7 is arranged in said second element 3, said first groove 6 and second groove 7 extending at least into each junction area 9. Such a component 1 also includes an inlay of an at least partially amorphous metallic material, at least partially filling first groove 6 and second groove 7 in each junction area 9 of first element 2 and second element 3.

As previously suggested, such a component 1 can be formed of more than two elements 2, 3, with one or more other elements 4, and with one or more third elements 10 inserted into the respective grooves 6, 7.

External component 1 is intended to be placed on a portable timepiece device, such as a watch. In particular, external component 1 may, in a non-limiting manner, form a watch bezel. Component 1 may be fixedly or movably mounted on the watch, by any securing means, particularly in a snap fit.

It is thus understood that timepiece component 1 may form all or part of an external component, such as, for example, a watch bezel, a bracelet link, a dial, a watch case or a clasp member, or may form all or part of a member of a timepiece movement. By way of example, it is possible to envisage making the balance, pallets, bridges or bars, oscillating weights or even the wheel sets, such as the escape wheels, completely or partially from ceramic. It is also possible to envisage making a case, a dial, a display, a decoration, an index, an applique, a flange, a bezel, a pusher, a crown, a case back, a hand or a bracelet wholly or partially from ceramic according to the invention.

Of course, the present invention is not limited to the illustrated example but is capable of various variants and modifications that will appear to those skilled in the art. In particular, the invention is not limited to an external component or even to the field of horology. Thus, by way of example, there is nothing to preclude using the assembly of the invention of a ceramic component 1 for an application in the field of tableware, or jewelry.

KEY TO DRAWINGS

1 External component
2 First element
3 Second element
4 Other element
5 Case
6 First groove
7 Second groove

8 Side walls 8 (of the first groove and of the second groove)
9 Junction areas
10 Third element

The invention claimed is:

1. A method for assembling at least a first element and a second element to form, once assembled, an external watch component for a portable device, comprising the steps of:

a) making the first element including a top side, a bottom side, and an edge extending between the top side and the bottom side, the first element being made of a first material;

b) making the second element including a top side, a bottom side, and an edge extending between the top side and the bottom side, the second element being made of a second material that is different than the first material;

c) arranging at least a first groove in the first element and at least a second groove in the second element;

d) placing and holding the first and second element end-to-end with at least a third connecting element which is inserted and locked in the first and second grooves such that the edge of the first element directly contacts the edge of the second element, the third element being an at least partially amorphous metallic material or a material resulting from electroforming.

2. The assembly method according to claim 1, wherein the step of inserting and locking the third element in the first and second grooves consists in filling the first and second grooves by inlaying the third element.

3. The assembly method according to claim 2, wherein said third element is the at least partially amorphous metallic material.

4. The assembly method according to claim 1, wherein the first and second elements are made of an electrically conductive material or wherein the walls of the grooves are coated with an electrically conductive material, wherein the step of inserting and locking the third element in the first and second grooves consists in metal filling the first and second grooves via an electroforming process.

5. The assembly method according to claim 1, wherein the first element has a first appearance and wherein the second element has a second appearance different from the first appearance of the first element.

6. The assembly method according to claim 1, wherein the first groove is in communication with the second groove when the two elements are placed end-to-end.

7. The assembly method according to claim 1, wherein the method further comprises, after step d), a step consisting in trimming said third element until the surfaces of the first, second and third elements are seamlessly connected to one another.

8. The assembly method according to claim 1, wherein said first material and said second material are polycrystalline or single crystal ceramic materials, made from aluminium oxide, zirconium oxide, tungsten carbide, silicon nitride, silicon carbide, tungsten carbide or cermets.

9. The assembly method according to claim 1, wherein said material forming the third element is chosen from the following group: precious or semi-precious metals.

10. The assembly method according to claim 1, wherein said material forming the third element is chosen from the group including alloys of gold, platinum or palladium.

11. The assembly method according to claim 1, wherein each groove is machined to form a recess having a trapezoidal cross section, the side walls of each groove being inclined and converging from the inside in the direction of the exterior of the groove.

12. The assembly method according to claim 1, wherein each groove is machined either on the upper side, or the lower side of said first element and said second element.

13. The assembly method according to claim 1, wherein each groove extends over the entire length of the first element and second element.

14. The assembly method according to claim 1, wherein each groove has a depth comprised between 0.05 mm and 4 mm.

15. The assembly method according to claim 1, wherein trimming is achieved by milling or turning.

16. An external component comprising at least the first element and the second element assembled according to the assembly method according to claim 1.

17. The external component according to claim 16, wherein said third element is the at least partially amorphous metallic material inlaid in said first and second grooves.

18. The external component according to claim 16, wherein said third element is electroformed in said first and second grooves.

19. The external component according to claim 16, wherein said first material and said second material are polycrystalline or single crystal ceramic materials, made from aluminium oxide, zirconium oxide, tungsten carbide, silicon nitride, silicon carbide, tungsten carbide or cermets.

20. The external component according to claim 16, wherein said material forming the third element is chosen from the following group: precious or semi-precious metals.

21. The component according to claim 20, wherein said material forming the third element is chosen from the group including alloys of gold, platinum or palladium.

22. The external component according to claim 16, wherein each groove has a trapezoidal cross section, the side walls of each groove being inclined and converging outwards from the inside.

23. The external component according to claim 16, wherein each groove extends over the entire length of the first element and second element.

24. The external component according to claim 16, wherein each groove has a depth comprised between 0.05 mm and 4 mm.

25. The external component according to claim 16, wherein the component forms a watch bezel or a watch case.

26. The external component according to claim 16, wherein the component has an annular shape, with each element forming an annular arc.

27. The external component according to claim 26, wherein said component forms a watch bezel.

28. The assembly method according to claim 1, wherein the first element and the second element have an identical shape and are made in a same mold.

29. An external component comprising at least:

a first element and a second element assembled in at least one junction area, the first element includes a top side, a bottom side, and an edge extending between the top side and the bottom side, the first element made of a first material, the second element includes a top side, a bottom side, and an edge extending between the top side and the bottom side, and the second element is made of a second material that is different than the first material;

a first groove arranged in said first element and a second groove arranged in said second element, said first groove and second groove extending at least into each junction area;

a third element, at least partially filling the first groove and second groove in each junction area of the first element and second element such that the edge of the first element directly contacts the edge of the second element, the third element being an at least partially amorphous metallic material or a material resulting from electroforming, wherein the external component is a component of a watch.

30. The external component according to claim 29, wherein the first element and the second element have an identical shape.

* * * * *